United States Patent [19]

Gorchev

[11] 3,981,326

[45] Sept. 21, 1976

[54] INDUCTION MIXING NOZZLE

[75] Inventor: Dimiter Gorchev, Washington, D.C.

[73] Assignee: Mitco Corporation, Somerville, Mass.

[22] Filed: Apr. 11, 1975

[21] Appl. No.: 567,383

Related U.S. Application Data

[63] Continuation-in-part of Ser. No. 446,606, Feb. 28, 1974, abandoned.

[52] U.S. Cl. ..... 137/604; 98/38 E; 417/189

[51] Int. Cl.[2] ..... F16K 19/00

[58] Field of Search ..... 98/38 E; 137/604; 417/187, 189; 48/180 P, 180 C

[56] References Cited

UNITED STATES PATENTS

| | | | |
|---|---|---|---|
| 861,193 | 7/1907 | McCabe | 417/187 |
| 871,209 | 11/1907 | Cotton | 417/189 X |
| 1,067,653 | 7/1913 | Hearing | 417/187 |
| 1,296,968 | 3/1919 | Klein | 98/38 E X |
| 1,739,161 | 12/1929 | McKee | 48/180 C |
| 1,802,019 | 4/1931 | Howson | 48/180 C |
| 1,987,883 | 1/1935 | White et al. | 417/187 X |
| 2,128,519 | 8/1938 | Adams | 48/180 C |
| 2,820,419 | 1/1958 | Albertson | 417/187 X |

FOREIGN PATENTS OR APPLICATIONS

| | | | |
|---|---|---|---|
| 672,693 | 9/1929 | France | 48/180 C |
| 672,777 | 9/1929 | France | 48/180 C |
| 159,197 | 6/1922 | United Kingdom | 48/180 C |

*Primary Examiner*—Robert G. Nilson
*Attorney, Agent, or Firm*—Kenway & Jenney

[57] ABSTRACT

An apparatus for mixing two fluids of the same phase. The apparatus includes a mixing nozzle, an adjustable flow rate injector for introducing an annular flow of primary fluid into the mixing nozzle at a selected primary fluid flow rate, and a nozzle port adjacent to the injector for introducing an induced annular flow of secondary fluid into the mixing nozzle, wherein the secondary fluid is of the same phase as the primary fluid. In this arrangement, the ratio of the secondary fluid flow rate to the primary fluid flow rate varies inversely with the primary fluid flow rate.

7 Claims, 6 Drawing Figures

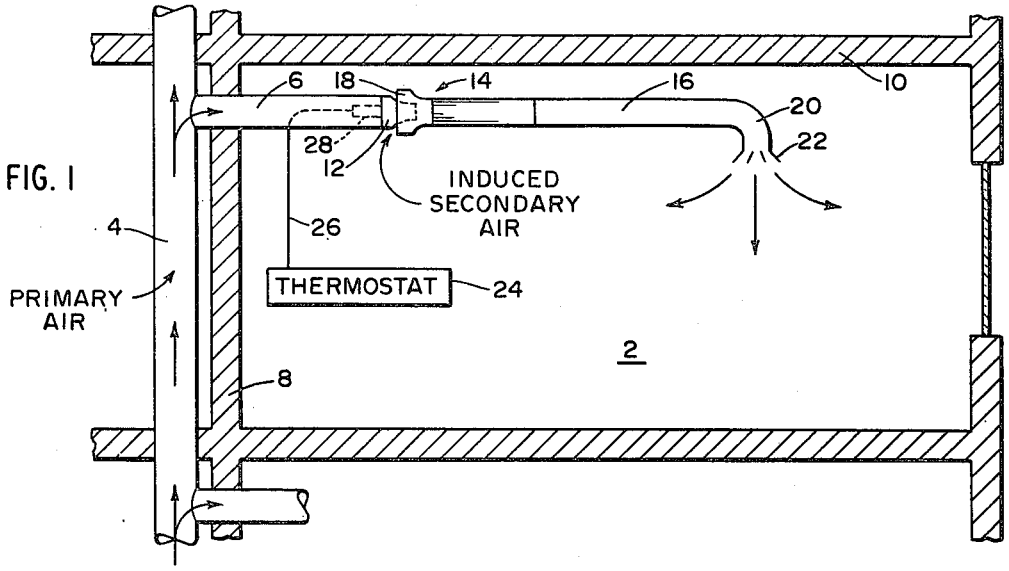
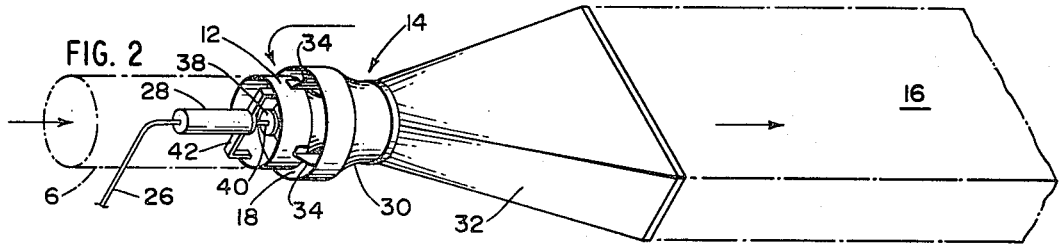
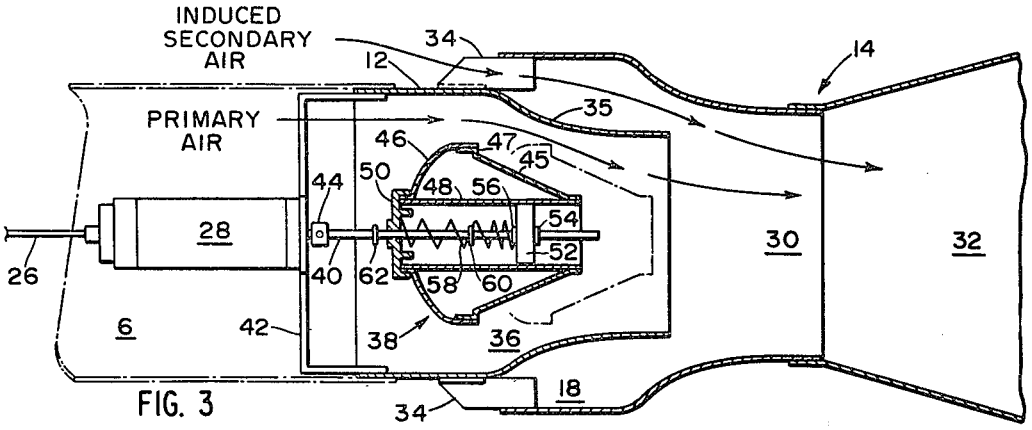
FIG. 3
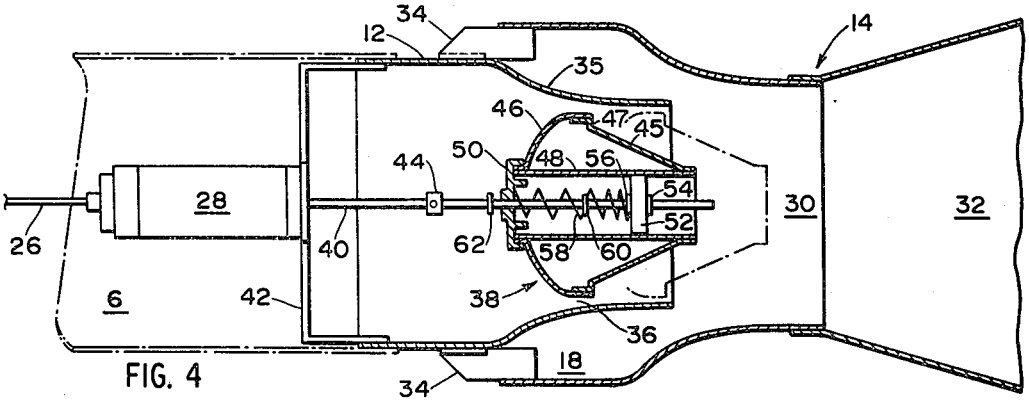
FIG. 4

INDUCTION MIXING NOZZLE

CROSS REFERENCE TO RELATED APPLICATION

This application is a continuation-in-part of my pending application, Ser. No. 446,606, filed Feb. 28, 1974, now abandoned.

BACKGROUND OF THE INVENTION

This invention pertains to the field of fluid mixing systems and more particularly, to induction nozzles associated with air circulation systems.

Induction mixing nozzles are frequently employed in air circulation systems. Generally, an induced secondary flow of ambient room air is mixed with a primary flow of supply air. Of course, the primary air temperature may be above the ambient air temperature for a heating system, and the primary air temperature may be below in an air conditioning (cooling) system. Alternatively, such air circulation systems may control humidity or some combination of temperature and humidity. Using induction mixing nozzles, the amount of duct work and insulation used in the system can be kept to a minimum and a sufficient mass flow rate of circulated air can be achieved without the necessity of injecting air flow directly into the room at high velocity or at extreme temperatures or humidity. The flow rate through the mixing nozzle is usually thermostatically controlled so that the ambient air temperature within the room can be maintained at a selected level. Pressure independent, constant flow rate valves of the type shown is U.S. Pat. No. 3,204,664 issued to Dimiter Gorchev, et al on Sept. 7, 1965, may be employed in such systems to automatically maintain a selected flow rate without the use of refined feedback controls.

In a typical prior art induction mixing apparatus, the secondary flow induction port surrounds a standard venturi nozzle. In this type of nozzle, the flow exits through a circular orifice, filling the entire plane of the oriface. In these devices, the ratio of the rates of induced secondary flow to primary flow is directly related to the primary flow rate. As a result, the composite flow rate decreases as the primary flow rate decreases. Thus, for example, in a heating system, as the room (ambient) temperature approaches a desired value, the flow rate of primary air (at high temperature) is reduced, thereby reducing the secondary and composity air flow rates. This dependence of the composite air flow rate upon the temperature differential between the secondary (ambient) and primary air leads to conditions where air circulation within a room might virtually cease.

A more complex type of induction nozzle is illustrated in U.S. Pat. No. 3,638,679, issued on Feb. 1, 1972 to Dimiter Gorchev. In that nozzle, the flow rate of the induced air is controlled by an adjustable valve and mechanical linkage so that the induced air enters a mixing nozzle at a rate that is inversely related to the flow rate of the primary air. As a result, a relatively constant flow rate, variable temperature output air flow may be provided by that mixing nozzle. However, the adjustable valve and mechanical linkage utilized by such induction nozzles form a complex mechanical arrangement which is correspondingly expensive to produce with tolerances which permit commercially acceptable temperature control, air flow and system reliability.

A further disadvantage to the prior art systems, is the high frequency noise generated by wave disturbances in the regions of the primary and secondary fluid ports.

Accordingly, it is an object of this invention to provide a relatively constant output flow rate induction nozzle for use in air circulation systems.

A further object is to provide an induction nozzle by which the temperature of the output mixture may be controlled by the primary fluid flow rate while the composite output flow rate is maintained relatively constant. A thermostat control associated with such a nozzle could respond to changes in room temperature by automatically selecting the optimum primary air flow rate since the temperature of the air entering the room through the mixing nozzle is always known.

Still another object is to provide a relatively low noise induction nozzle for use in air circulation systems.

SUMMARY OF THE INVENTION

I have discovered that, by employing a primary fluid nozzle, or injector, for providing an annular primary fluid flow adjacent to and interior of the annular induction port of an induction mixing nozzle, the rate of flow of the primary fluid entering through the primary fluid nozzle is inversely proportional to the flow rate of the induced secondary flow. Thus, for example, as the primary fluid flow rate is throttled down, the induced secondary fluid flow rate increases with the result that the rate at which the mixed flow leaves the mixing nozzle can be maintained relatively constant. Accordingly, since the flow rate of the primary fluid controls the mixture proportion of the output from the mixing nozzle, a simple mechanical flow rate control in the primary fluid flow supply may control the temperature of the composite output of the mixing nozzle to be at a selected value between the temperatures of the primary and secondary fluids.

In one embodiment, the primary fluid injector is formed by a conduit having a tapered nozzle at one end, and a plunger coaxially mounted within the conduit, forming an annular passage therethrough. The plunger has a tapered portion with the lesser diameter end of the plunger being blunt and adjacent to the tapered end of the tapered nozzle. The primary fluid flow rate may be controlled in this embodiment by adjusting the position of the plunger along the axis of the conduit.

Furthermore, by establishing a uniformly spaced series of notches about the circumference of the surface of the plunger, the high frequency audible whistle associated with many prior art induction nozzles is substantially eliminated.

Since the primary fluid nozzle is annular, the plunger can be spring mounted, permitting motion within the primary flow nozzle along the nozzle axis to maintain a selected primary fluid flow rate, substantially independent of the primary fluid input pressure. Thus, in air circulation systems, for example, a room thermostat can precisely select a desired temperature, which will be maintained with relatively constant air flow and without complicated and expensive controls.

BRIEF DESCRIPTION OF THE DRAWINGS

The several features and advantages of induction mixing nozzles constructed in accordance with the invention will be more readily understood and appreciated from the following detailed description of a preferred embodiment thereof, selected for purposes of illustration, and shown in the accompanying drawings in which:

FIG. 1 is a view in side elevation and partly in section of an overall air circulation system constructed in accordance with the invention;

FIG. 2 is a perspective view of an induction mixing nozzle constructed in accordance with the invention; FIG. 3 is a plan view partly in section of the nozzle shown in FIG. 2;

FIG. 4 is the same view as in FIG. 3, showing the nozzle in a reduced flow rate position;

DESCRIPTION OF THE PREFERRED EMBODIMENT

Figure 5:
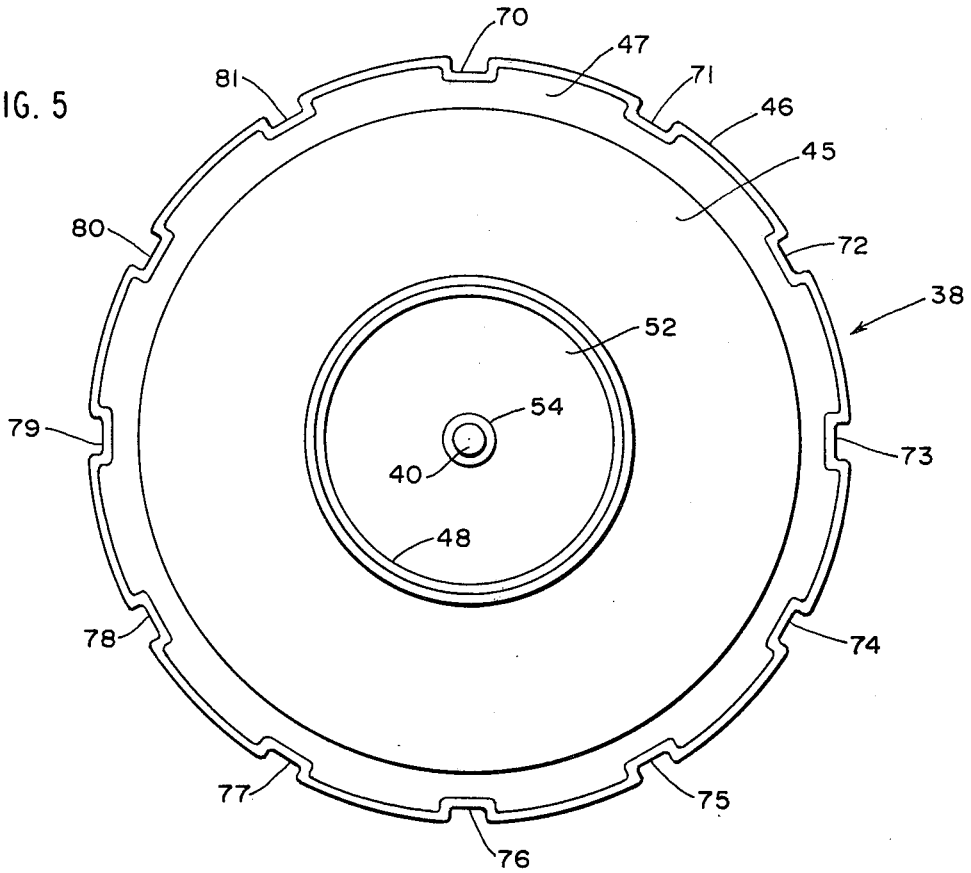
FIG. 5 is a side view of the plunger of the embodiment of FIG. 2.

As shown in FIG. 1, a room 2 receives a supply of primary air from a main supply duct 4 located outside of the room by means of a branch supply conduit 6 which passes through wall 8 and enters the room adjacent to its ceiling 10. A supply nozzle 12 attached to the end of the branch conduit 6 directs an annular flow of primary supply air directly into an induction mixing nozzle 14 attached to one end of a room air supply duct 16 positioned adjacent to the ceiling 10. An induction mixing port 18 surrounds the supply nozzle 12 and feeds an induced secondary flow of ambient room air into the mixing nozzle 14 immediately adjacent the orifice of the nozzle 12. The secondary and primary air flows are intermixed within the nozzle 14 as they flow therethrough and are fed directly into the room supply duct 16 which carries the mixed flow along its length, through a downwardly directed elbow 20 formed in the duct, and feeds the flow into the room 2 through a circular diffuser 22 attached to its other end. A thermostat 24 located within the room 2 senses the ambient room air temperature and, through line 26, adjusts a primary flow rate control 28 positioned within conduit 6 in response to changes in the ambient room air temperature. I have found that by forming an annular flow immediately adjacent to the induction port opening within the induction mixing nozzle 14, a change in the mass flow rate of the primary air through the nozzle 12 induces an inversely related change in the mass flow rate of the secondary air. As a result, the mixture ratio of the two flows may be controlled via selecting an appropriate primary air flow rate while the total mass flow rate is maintained relatively constant. By changing the primary flow rate in response to the thermostat 24, variations in room temperature may be controlled while maintaining a relatively constant degree of air circulation.

In this system, the cross sectional areas of the main supply duct 4 and the branch supply conduit 6 can be efficiently reduced by increasing the temperature difference between the primary air supply and the ambient room air. This modification does not require a substantial increase in the velocity of the primary air, since the required circulation is maintained by adding the induced secondary air flow to the primary supply flow. Thus, the material and installation costs of the system can be reduced without a loss in system efficiency.

Referring to FIGS. 2–4, the mixing nozzle 14 is comprised of an axially symmetrical tapered throat section 30 and an expansion chamber 32 which receives the flow as it leaves the throat 30. The throat 30 is organized about the supply nozzle 12, which is coaxially mounted within the throat 30 by a set of symmetrically spaced struts 34. The nozzle 12 forms an annular induction port 18 within throat 30, which is open to the atmosphere within the room 2.

An axially symmetrical accelerating flow section 35 is formed in the nozzle 12 by the tapered nozzle walls near the end of the nozzle 12. Within the acceleration section 35, an annular fluid passage 36 is defined by a plunger 38 reciprocably mounted on a support rod 40, with its upstream side facing the flow of the primary fluid coming from the left as shown. The plunger 38 is arranged within the acceleration section 35 so that the area of passage 36 decreases as the plunger is moved to the right and increases as the plunger is moved to the left. The position of the plunger 38 within section 35 is controlled by the rod 40 which extends along the axis of the nozzle 12 and is attached at its left end to the primary flow control 28 mounted within the nozzle by a strut 42 attached at its opposite ends to the walls of the nozzle 12 between the plunger 38 and the flow control 28. The flow control cylinder 28 adjusts the position of the rod 40 and the plunger 38 within the nozzle 12 in response to the signals received from the thermostat 24. The maximum movement of the rod 40 to the left is controlled by a stop 44 attached to the rod between the plunger 38 and the strut 42.

As the plunger 38 is reciprocated within the nozzle 12 and the area of the passage 36 is thereby altered, the flow of the primary supply air through the nozzle is correspondingly changed. Since the annular velocity profile of the fluid flowing within the passage 36 extends beyond the end of the nozzle 12, a change in the flow rate through the nozzle 12 induces an inversely related change in the induced secondary flow rate through the port 18. Thus, the mixture proportion of the primary and secondary fluids ejected from the mixing nozzle 14 can be accurately selected by control 28 with relatively little change in the composite mixture flow rate.

In the preferred embodiment shown, the plunger 38 is a hollow body of revolution comprised of a tapered portion 45, an outer shell portion 46, and a junction portion 47. The outer shell portion 46 is adjacent to and extends with decreasing radius away from the greater diameter end of the tapered portion 45. In addition, the maximum diameter of shell portion 46 is greater than the maximum diameter of the tapered portion 45. The junction portion 47 is substantially annular and connects the outer shell portion 46 to the tapered portion 45. In this embodiment, the lesser diameter end of the tapered portion 45 is blunt so that the annular primary fluid flow past the plunger 38 has a relatively high velocity at the edge of the tapered nozzle 35 near the induction port 34, and a relatively low velocity otherwise.

The portions 45 and 46 are attached to and surround an inner cylinder 48 extending the length of the plunger around the rod 40. At their left ends, both the shell 46 and the cylinder 48 are attached to and supported on the rod 40 by a nose cone lock bushing 50. To the right of the nose bushing 50, the inner cylinder is supported by a cup bushing 52 fixedly positioned on the rod 40 by a pair of stops 54 and 56 placed on either side of it. A compression spring 58 contained within the cylinder 48 surrounds the rod 40 and is held in compression by the bushings 50 and 52. The maximum compression of the spring 58 is controlled by a stop 60 attached to the rod 40 within cylinder 48 between the nose bushing 50 and the cup bushing 52. The maximum extension of the spring 58 is controlled by a stop 62 attached to the rod 40 between the stop 44 and the plunger 38. The drag force exerted on the plunger 38 by the fluid moving past it is transferred to the spring 58, which is in turn, supported by the cup bushing 52. Since the cup bushing 52 is fixedly positioned on the rod 40, any movement of the rod results in a change in position of the plunger 38. In this manner, the flow rate through the nozzle 12 can be thermostatically controlled as described above. This feature is diagramatically illustrated by the dotted lines in FIGS. 3 and 4.

Within the range of plunger movement permitted by the stops 60 and 62, the spring 58 is designed to adjust the position of the plunger 38 along the rod 40 in response to variations in the fluid drag, so that, for any given position of the rod 40 within the nozzle 12, the primary fluid flow rate through the nozzle 12 remains constant irrespective of fluctuations in the pressure of the primary fluid entering the nozzle 12. Thus, the primary fluid mass flow rate is not affected by pressure variations upstream of the nozzle 12.

Figure 6:
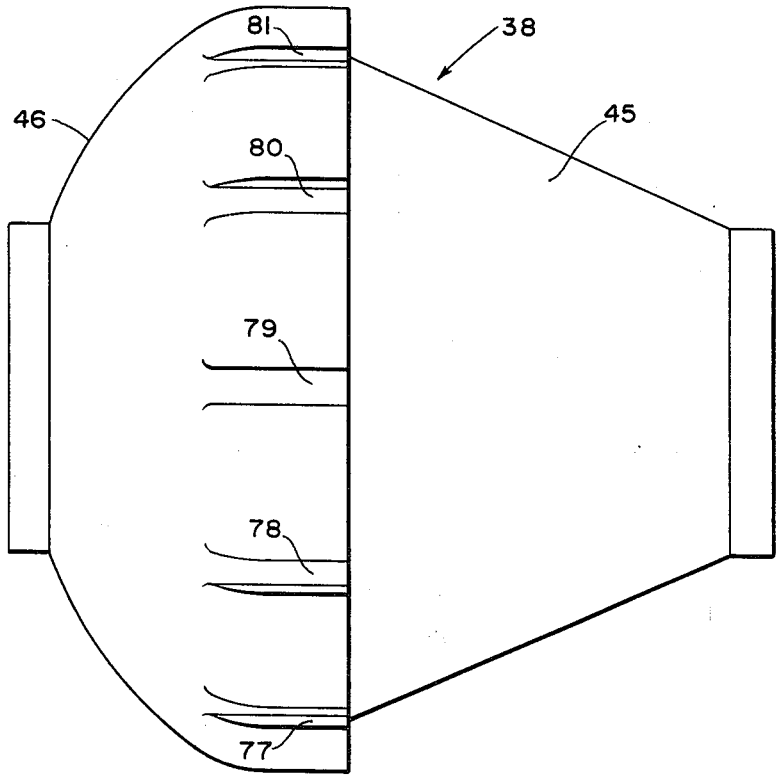
FIG. 6 is an end view of the plunger of FIG. 5.

FIGS. 5 and 6 shoe the outer configuration of the plunger 38. Notches 70–80 extend radially inward from the outer surface of plunger 28 at the point of the largest diameter. The notches 70–81 are uniformly distributed about the circumference of the plunger 38. These notches disperse the high frequency acoustic wave disturbances which would otherwise propagate around the relatively narrow annular region between plunger 38 and accelerator section 35 at certain positions of plunger 38 along its axis. The dispersion of these wave disturbances is effective to substantially eliminate the high frequency whistle or noise which would otherwise radiate out through the induction port 34 and the mixing nozzle 30.

While I have illustrated my induction mixing nozzle with an axially symmetric, annular primary flow, two dimensional and other forms of primary flow nozzles creating a similar high edge velocity near the induction port will also produce similar proportionality changes in mixing in response to primary fluid mass flow variations and come within the scope of my invention.

Since various changes may be made in my invention without departing from the scope of the invention, the above description of the preferred embodiment shall be interpreted as illustrative and not in a limiting sense.

Having described my invention, what I claim as new and desire to secure by Letters Patent is:

1. An apparatus for mixing two gas phase fluids in an air circulation system comprising:

A. a mixing nozzle;

B. adjustable flow rate injection means for introducing an annular flow of primary fluid into said mixing nozzle at a selected primary fluid flow rate; and C. a port in said mixing nozzle adjacent to said injection means for introducing an induced annular secondary flow of fluid into said mixing nozzle, wherein said injection means comprises:

i. a conduit having a tapered nozzle at one end thereof;

ii. a plunger coaxially mounted within said conduit to define an annular passage within said tapered nozzle, said plunger having a tapered portion wherein the lesser diamter end of said tapered portion is adjacent to the tapered end of said tapered nozzle, and wherein further the lesser diameter end of said tapered portion is blunt so that the annular primary fluid flow past said plunger has a relatively high velocity at the edge of said tapered nozzle near said induction port, and a relatively low velocity otherwise; and iii. means for adjusting the position of said plunger along the axis of said conduit, and further comprising a primary fluid velocity responsive means supporting said plunger within said conduit to maintain a constant primary fluid flow rate therethrough, said primary fluid flow rate being relatively independent of primary fluid input pressure variations.

2. An apparatus for mixing two gas phase fluids in an air circulation system comprising:

A. a mixing nozzle;

B. adjustable flow rate injection means for introducing an annular flow of primary fluid into said mixing nozzle at a selected primary fluid flow rate; and C. a port in said mixing nozzle adjacent to said injection means for introducing an induced annular secondary flow of fluid into said mixing nozzle, wherein said injection means comprises:

i. a conduit having a tapered nozzle at one end thereof;

ii. a plunger coaxially mounted within said conduit to define an annular passage within said tapered nozzle, said plunger having a tapered portion wherein the lesser diameter end of said tapered portion is adjacent to the tapered end of said tapered nozzle, and wherein further the lesser diameter end of said tapered portion is blunt so that the annular primary fluid flow past said plunger has a relatively high velocity at the edge of said tapered nozzle near said induction port, and a relatively low velocity otherwise; and iii. means for adjusting the position of said plunger along the axis of said conduit, and wherein said plunger further has an outer shell portion and a junction portion, wherein said outer shell portion is adjacent to and extends with decreasing radius away from the greater diameter end of said tapered portion, said outer shell portion having a largest diameter exceeding the largest diameter of said tapered portion, and wherein said junction portion is substantially annular and connects said outer shell portion to said tapered portion.

3. An apparatus for mixing two gas phase fluids in an air circulation system comprising:

A. a mixing nozzle;

B. adjustable flow rate injection means for introducing an annular flow of primary fluid into said mixing nozzle at a selected primary fluid flow rate; and C. a port in said mixing nozzle adjacent to said injection means for introducing an induced annular secondary flow of fluid into said mixing nozzle, wherein said injection means comprises:

A. a conduit having a tapered nozzle at one end thereof;

B. a plunger coaxially mounted within said conduit to define an annular passage within said tapered nozzle, said plunger having a tapered portion wherein the lesser diameter end of said tapered portion is adjacent to the tapered end of said tapered nozzle, and wherein further said plunger includes a plurality of notches extending radially inward from its outer surface at the point of largest diameter, said notches being uniformly distributed about the circumference of said plunger; and C. means for adjusting the position of said plunger along the axis of said conduit.

4. The apparatus according to claim 3 wherein said plunger further has an outer shell portion and a junction portion, wherein said outer shell portion is adjacent to and extends with decreasing radius away from the greater diameter end of said tapered portion, said outer shell portion having a largest diameter exceeding the largest diameter of said tapered portion, and wherein said junction portion is sustantially annular and connects said outer shell portion to said tapered portion.

5. The apparatus according to claim 3 further comprising a primary fluid velocity responsive means supporting said plunger within said conduit to maintain a constant primary fluid flow rate therethrough, said primary fluid flow rate being relatively independent of primary fluid input pressure variations.

6. An apparatus for mixing two gas phase fluids in an air circulation system comprising:

A. a mixing nozzle;

B. adjustable flow rate injection means for introducing an annular flow of primary fluid into said mixing nozzle at a selected primary fluid flow rate; and C. a port in said mixing nozzle adjacent to said injection means for introducing an induced annular secondary flow of fluid into said mixing nozzle, wherein said injection means comprises:

i. a conduit having a tapered nozzle at one end thereof;

ii. a plunger coaxially mounted within said conduit to define an annular passage within said tapered nozzle, said plunger having a tapered portion wherein the lesser diameter end of said tapered portion is adjacent to the tapered end of said tapered nozzle, iii. means for adjusting the position of said plunger along the axis of said conduit, and further comprising a primary fluid velocity responsive means supporting said plunger within said conduit to maintain a constant primary fluid flow rate therethrough, said primary fluid flow rate being relatively independent of primary fluid input pressure variations.

7. An apparatus for mixing two gas phase fluids in an air circulation system comprising:

A. a mixing nozzle;

B. adjustable flow rate injection means for introducing an annular flow of primary fluid into said mixing nozzle at a selected primary fluid flow rate; and C. a port in said mixing nozzle adjacent to said injection means for introducing an induced annular secondary flow of fluid into said mixing nozzle, wherein said injection means comprises:

i. a conduit having a tapered nozzle at one end thereof;

ii. a plunger coaxially mounted within said conduit to define an annular passage within said tapered nozzle, said plunger having a tapered portion wherein the lesser diameter end of said tapered portion is adjacent to the tapered end of said tapered nozzle, iii. means for adjusting the position of said plunger along the axis of said conduit, and wherein said plunger further has an outer shell portion and a junction portion, wherein said outer shell portion is adjacent to and extends with decreasing radius away from the greater diameter end of said tapered portion, said outer shell portion having a largest diameter exceeding the largest diameter of said tapered portion, and wherein said junction portion is substantially annular and connects said outer shell portion to said tapered portion.

* * * * *